United States Patent [19]

Blade et al.

[11] 4,325,755

[45] Apr. 20, 1982

[54] FORMABLE ALUMINUM ALLOY SHEET PRODUCT

[75] Inventors: John C. Blade, Banbury; John Ridley, Newport; Geoffrey C. Wood, Bloxham, all of England

[73] Assignee: Alcan Research and Development Limited, Montreal, Canada

[21] Appl. No.: 180,859

[22] Filed: Aug. 25, 1980

[30] Foreign Application Priority Data

Aug. 30, 1979 [GB] United Kingdom ..... 30003/79

[51] Int. Cl.[3] ..... C22C 21/02

[52] U.S. Cl. ..... 148/32; 75/143; 148/2; 148/11.5 A

[58] Field of Search ..... 148/32, 2, 11.5 A; 75/143, 142, 141

[56] References Cited

U.S. PATENT DOCUMENTS 3,676,111 7/1972 Wieser et al. ..... 75/143

FOREIGN PATENT DOCUMENTS 52-6683 2/1977 Japan .

*Primary Examiner*—R. Dean

*Attorney, Agent, or Firm*—Cooper, Dunham, Clark, Griffin & Moran

[57] ABSTRACT

An aluminum sheet product is formed from an alloy containing Fe 0.6–1.0%, Si 0.5–0.9% and Cu 0.3–0.5% and includes Ti and B in conventional grain refining amount. Mn is permissible in amounts up to 0.2–0.3% but is preferably held below 0.1%. The Mg impurity content is preferably held at a very low value so as to avoid difficulties with adhesion of lacquer.

The principle use of the sheet product is for the production of bottle closures and for that purpose it is preferably produced in a thickness of 0.15–0.25 mm. and in a quality having a low percentage earing and fine grain size. For this purpose the sheet is subjected to a temper cold rolling reduction of 30–60% after the last interannealing treatment. No homogenization treatment is required before hot reduction of the cast ingot and no precipitation heat-treatment is applied to the hot-rolled product before cold rolling.

12 Claims, No Drawings

FORMABLE ALUMINUM ALLOY SHEET PRODUCT

The present invention is concerned with an aluminium alloy sheet product, primarily intended for use for packaging purposes, but also useful for other purposes when produced in appropriate thickness. Small grain size is important in aluminium alloy sheet product intended to be formed into a product which may be judged by surface appearance. A sheet product is today considered to be commercially acceptable when grain size is even as high as 200 microns. However a product having a grain size in the range of 50–70 microns is greatly preferred for reasons of superior appearance.

Although the invention is described primarily with reference to a sheet product for the production of bottle closures, which require a sheet product of a thickness in the range of 0.15–0.25 mm., the invention is applicable to sheet products in a thickness range of 3 mm. as required for pressings for kitchen utensils, down to 15 microns for very thin aluminium foil.

Large quantities of aluminium alloys are used for the production of bottle closures and similar purposes, such as production of can ends and foil containers. For bottle closures there is a requirement for sheet having good formability in conjunction with adequate strength to withstand the forces generated by carbonated beverages, coupled with good lacquer adhesion, since a closure formed from the sheet will come into contact with liquids, particularly beverages.

It will be clear that provided required lacquer adhesion and formability characteristics are present, an increase in the strength characteristics of the alloy (over other alloys employed for the same purpose) can lead to substantial economies, because it permits the sheet to be employed at a lower gauge (thickness) to perform a particular function. For instance a thickness reduction of as little as 0.01 mm. (about 4%) can lead to significant economies in the production of bottle closures and other similar articles.

Similar economies can be achieved if expensive long-time, high-temperature heat treatments can be obviated.

It is well known that the presence of magnesium oxide in the oxide surface layer on aluminium reduces the lacquer adhesion characteristics of an aluminium alloy sheet and for that reason it is already common practice to restrict the Mg content of an Al alloy for packaging to impurity levels, so that the Mg level of many known alloys for the present purpose is commonly no more than 0.05%. Such alloys can be considered as Mg-free and the alloy of the present invention is an alloy of that class.

Bottle closures are frequently externally printed. The printed message is applied to the flat sheet before the individual closure blanks are stamped out of the sheet and drawn into closures. In order that the printed message shall not become unduly distorted in the drawing operation for deep drawn closures of the pilferproof type it is important that the earing value exhibited by the sheet does not substantially exceed 2%, although this is less important with shallower closures, which are not printed on the skirt. Higher earing values are acceptable for shallow closures of the clip-on type; also for shallow containers of the type employed for packing individual portions of foodstuffs.

The earing value exhibited by an aluminium alloy sheet is dependent both upon the alloy composition and upon the conditions under which the sheet product is produced from the initial as-cast or hot-rolled slab. In particular earing at 45° to rolling direction tends to increase with increase in the percentage cold reduction applied during temper rolling, that is to say, cold rolling applied after the final annealing heat treatment to increase the strength of the product. For packaging purposes, particularly for the production of bottle closures, it is desirable that the alloy should be capable of being processed to exhibit a low earing value after a large final percentage reduction (in excess of 30%) by temper rolling.

According to the present invention an aluminium alloy sheet product is produced from an aluminium alloy having the composition:

Fe 0.6–1.0%
Si 0.5–0.9%
Cu 0.3–0.5%
Mn up to 0.3%
Ti+B in conventional grain refining amount (Ti+B 0.006–0.06%)
Others up to 0.15% total and 0.05% each
Al balance It is preferred that the Fe and Si contents should each be in the range 0.6–0.8%. The Fe+Si content should preferably not exceed 1.6% and should preferably be in the range 1.30–1.50%. When Fe+Si content rises above 1.6% earing progressively increases. The ratio Fe/Si preferably is not less than 1.00 so as to control grain size. The ratio Fe/Si should not be less than 0.9 and preferably does not exceed 1.4.

Mg content is preferably no higher than 0.02% and even more preferably no higher than 0.01% to avoid all possibility for requirement of surface treatment to remove surface oxide before lacquering.

Manganese is preferably in an amount no more than 0.2% and usually is present in no more than impurity amount (below 0.05%). However it may be desirable to add manganese in amounts up to 0.3% to improve the strength of the alloy where a relatively large grain size is of lesser importance.

It is already well known to produce aluminium alloy sheet for production of bottle closures in an alloy containing 1% Mn and 0.3% Cu, usually with a small addition of chromium. However such alloy required prolonged homogenisation heat treatment of the ingot before hot rolling in order to achieve appropriately low grain size and low earing values in the final cold-rolled sheet product.

The alloy of the present invention results in the production of an alloy sheet product which has similar strength and earing characteristics to that known product, but which is easier to produce because no homogenisation of the ingot is required to maintain the grain size at an acceptable level. In consequence the cost of processing the alloy to the final sheet product is reduced in relation to the known manganese-containing alloy sheet.

It is already well known to produce an aluminium alloy sheet containing 0.75% Fe and 0.75% Si. The material has substantially lower strength than the alloy sheet of the present invention when produced in a temper suitable for production of deep-drawn closures and is therefore not competitive with other known products for that purpose.

As compared with the known Al-Mn-Cu alloy the low level of Mn content leads to a reduction in the grain size and permits a greater reduction by temper cold rolling without giving rise to high earing values. As the Mn content of the alloy of the invention is increased from an impurity level of below 0.05% to 0.2–0.3% the grain size and earing value somewhat increases but there is some advantageous increase in tensile strength, for a given final temper rolling reduction.

In the production of bottle closures it is important that the sheet is of consistent strength qualities. Material that is stronger than the specified strength can lead to difficulties in the production and utilisation of bottle closures, particularly bottle closures of the pilferproof type.

In the production of bottle closures (and of other articles formed by drawing circular blanks) very large amounts of scrap are generated as a result of punching the circular blanks out of sheet. This scrap is customarily recycled to the sheet producer.

It is far simpler (and therefore less costly) to maintain uniform quality when the number of alloying constituents is kept small, particularly when a large proportion of recycled scrap is employed. Bearing in mind that the levels of Fe and Si always require control in aluminium alloys, the alloy of the present invention requires only addition of Cu, as compared with Mn, Cu and Cr in the known alloy referred to above and is therefore advantageous over the known alloy from that aspect. It is also one of the reasons influencing a preference to holding the Mn content of the present alloy to a level of less than 0.1%.

Al-Fe-Si alloys, containing Cu additions, in accordance with the invention have been examined experimentally in the laboratory using 63.5 mm. thick D.C. ingots rolled by a practice designed to simulate the homogenisation and rolling practice used commercially to produce closure stock from manganese-containing Al alloys. The two alloys used were as follows:

| Identity | Cu % | Fe % | Mg % | Mn % | Si % | Ti % | Zn % |
|---|---|---|---|---|---|---|---|
| C1 | 0.38 | 0.76 | <0.01 | <0.01 | 0.71 | 0.023 | 0.01 |
| C2 | 0.39 | 0.78 | <0.01 | 0.19 | 0.75 | 0.02 | 0.01 |

These were homogenised at 610° C. during 9–10 hours, cooled to 570° C. and hot rolled to 19 mm., reheated to 450° C. and hot rolled to 3.6 mm. to simulate a practice employed for the known Al-Mn 1% alloy. The slab temperatures at that point were about 170° C., i.e. much lower than in commercial rolling. After cold rolling to 0.91 mm. the material was annealed at 380° C., cold rolled to 0.33 mm., annealed again, and finally cold rolled to 0.23 mm., i.e. ~30% cold reduction, after annealing. The strength, earing and grain size of the final sheet material are given in the table below. Also included are the properties of three known alloys, temper-rolled to an approximately equivalent condition, and subjected to the same homogenisation treatment before hot rolling, except for the Al-Fe-Si alloy.

| Identity | 0.2% Proof Stress (MPa) | U.T.S. (MPa) | Elong. % | Earing % | Grain Size (Microns) |
|---|---|---|---|---|---|
| C1 | 145 | 154 | 2½ | 0.8 | 45 |
| C2 | 151 | 160–184 | 2 | 1.3–2.3 | 45–55 |
| Al/1% Mn | 137 | 150–155 | 2 | 1.3 | 150 |
| Al—Fe 0.75%—Si 0.75% | 123 | 138 | 2 | 1.9 | 60 |
| Al/Mn 1%/Cu 0.4%/Cr 0.2% | 174 | 183 | 2 | 2.4 | 80–120 |

This shows that the addition of ~0.4% Cu to the known Al-Fe-Si alloy produces a strengthening and that is this condition its properties are similar to those of the known Al-1% Mn alloy. It can be seen that the homogenisation treatment has failed to reduce the grain size of Al-1% Mn alloy to the preferred level.

The effect of the Cu addition to the known Al-Fe-Si alloy will be seen to increase the strength of the cold-rolled sheet product by at least 10% while retaining advantageous earing characteristics and fine grain size, so that it allows a thickness reduction of the order of 10% without loss of overall strength. When Cu is added in amounts below 0.3% the increase in strength is less and the product is insufficiently strong as to be competitive with other known products which exhibit the desired low earing value and small grain size. When the Cu content is raised above 0.5% the formability and corrosion resistance of the alloy declines.

It was predicted that increasing the cold reduction of alloy C1 to approximately 40% and 50% to give either H.15 or H.16 temper would raise the U.T.S. to 179 MPa and 183 MPa respectively under these laboratory conditions. Increased temper rolling increases 45° earing but it is known that the low hot mill slab temperature in the laboratory trials will have accentuated the 45° earing in comparison with commercial rolling conditions, hence the earing at the higher reduction of 40–50% would still be expected to be within the 2% maximum required, and this was confirmed in further trials.

These further trials were carried out on a larger scale, in which the specification of the alloy was as follows:

| | Cu | Fe | Mg | Si | Ti | Others Each | Others Total |
|---|---|---|---|---|---|---|---|
| % max. | 0.45 | 0.80 | 0.01 | 0.80 | 0.05 | 0.05 | 0.15 |
| % min. | 0.35 | 0.60 | — | 0.60 | 0.02 | — | — |
| % nominal | 0.40 | 0.70 | — | 0.70 | 0.03 | — | — |

The ingots employed in this trial were full-size commercial rolling ingots. After scalping the ingots were preheated to achieve temperature equalisation before rolling by holding at 570°–580° C. for 6 hours, compared with a typical practice for homogenising Al-1% Mn alloys, which involves holding at a temperature of 590°–625° C. for 12–70 hours. The ingot was then hot-rolled to hot-mill coil material at a thickness in the range of 3–4 mm. This was then cold rolled down to closure stock gauge with final temper reductions of 40% and 50% respectively. The heating applied to the ingot before hot rolling was typical of the heating conventionally employed to ensure that a large ingot is brought to a uniform temperature and is typical of that applied to unalloyed aluminium ingot before hot-rolling.

Properties obtained were as follows:

| Temper | 0.2% P.S. (MPa) | U.T.S. (MPa) | Elong. % | Earing % | Grain Size (Microns) |
|---|---|---|---|---|---|
| H15 | 158 | 168 | 1¾ | 1.6 | 63 |
| H16 | 165 | 180 | 2 | 1.9 | 61 |

The above noted properties are those obtained before the sheet is lacquered. The application of lacquer is conventionally followed by a stoving treatment, which leads to some annealing and reduction in the strength of the sheet.

Since there is a possibility that the use of this alloy could be extended to other applications requiring higher strength but not necessarily such good earing behaviour, harder tempers were assessed. For this purpose samples of a hot-rolled mill coil were subjected to four rolling practices, chosen for evaluation. These were as follows:

A. Cold rolled to 0.040 in. (1 mm.), annealed, cold rolled to 0.0145 in. (0.37 mm.), annealed and temper-rolled to 0.0087 in. (0.22 mm.).

B. Cold rolled to 0.040 in. (1 mm.), annealed, cold rolled to 0.009 in. (0.23 mm.).

C. Annealed and cold rolled to 0.009 in. (0.23 mm.).

D. Cold rolled (without annealing) to 0.009 in. (0.23 mm.).

Practice A was effectively the practice of the foregoing large scale trials to produce H.15 temper. Annealing was at 380° C. for 2 hours. One edge and one centre of the hot-rolled mill coil sample was rolled by each practice.

Earing and tensile tests were carried out on the material at final gauge. Grain sizes were determined for practices A, B and C either at the last anneal stage or, as in the case of practice C, after some cold rolling. In addition, material from practices C and D were treated, before tensile testing, for 20 mins. at 205° C. to simulate a fairly severe stoving treatment after lacquering.

The results of the tests are given in the table below. The strength increases progressively with cold rolling reduction as would be expected. However, for the practices C and D there is little to choose in mechanical properties between material annealed at the hot mill coil stage and that which has not been annealed.

The amount of 45° earing increases with cold rolling and it can be shown that this increase is approximately linear with the cold reduction when it is expressed as a true rolling strain. Hot mill coil annealing results in only a marginal reduction in the earing resulting from practice C as compared with practice D.

The grain sizes were all fine, the coarsest being as expected that of material annealed at the hot mill coil stage with a grain size of around 50–70 microns. Both the A and B practices gave grain sizes finer than those quoted for some commercially produced material for bottle closures.

The properties obtained are recorded in the following table.

| Practice | Sample | Earing % | 0.2% MPa | U.T.S. MPa | Elong. % | Grain Size Microns |
|---|---|---|---|---|---|---|
| A | edge | 1.0 | 153 | 164 | 1 | 32 |
| 38% Reduction Temper | middle | 0.3 | 148 | 160 | 2 | 30 |

-continued

| Practice | Sample | Earing % | 0.2% MPa | U.T.S. MPa | Elong. % | Grain Size Microns |
|---|---|---|---|---|---|---|
| B | edge | 7.4 | 194 | 209 | 2 | 27 |
| 78% Temper Reduction | middle | 6.6 | 195 | 208 | 2 | 31 |
| C H19 | edge | 9.7 | 221 | 247 | 3 | 68 |
| 94% Temper Reduction | middle | 11.6 | 221 | 246 | 2 | 48 |
| D H19 | edge | 13.4 | 218 | 244 | 2 | — |
| 94% Temper Reduction | middle | 11.8 | 224 | 250 | 2½ | — |
| C (stoved) | edge | — | 166 | 181 | 2 | — |
| 20 mins. 205° C. | middle | — | 174 | 183 | 2 | — |
| D (stoved) | edge | — | 177 | 189 | 2 | — |
| 20 mins. 205° C. | middle | — | 176 | 184 | 2½ | — |

It follows from the above figures and from the tests stated earlier herein that the final temper-rolling reduction should not greatly exceed 50% (should not be more than about 60%) so long as it is desired to retain an earing value below or not greatly exceeding 2%. The temper rolling reduction should not be much less than 30% to achieve a minimum U.T.S. of 150 MPa. However where strength, as opposed to low earing values, is of greater importance, as for instance in the case of aluminium foil for domestic use, then it would be preferred to use temper rolling reductions in excess of 80%.

The sheet products produced from the different compositions described herein all exhibit grain sizes substantially below a commercial acceptable limit and indeed all show a grain size below 100 microns.

It will be noted that no heat treatment of the hot rolled slab before commencement of cold-rolling was employed in practices A and B, where annealing was applied at an intermediate stage or stages in the cold-rolling schedules. The initial annealing treatment employed in practice C showed little if any advantage over practice D.

The sheet product of the present invention is a work-hardened product and its production does not involve any precipitation heat treatment of the product after the completion of hot working. Subsequent heat treatment of the strip is limited to annealing at intermediate stages for recrystallisation to effect control of earing and for softening the material to reduce the work involved in subsequent cold rolling stages. Where earing characteristics are of little importance it can be seen from the above results that a product can be produced without any annealing stage.

All percentages and ratios relating to alloy compositions herein described are by weight.

The method of producing the alloy sheet product of the present invention has been described in terms of its production on a commercial scale from a conventional commercial rolling ingot which has a thickness such that it requires substantial thickness reduction by hot rolling before being subjected to reduction by cold rolling. The alloy employed for the production of the sheet product is however capable of being cast at a thickness suitable for reduction by cold rolling alone by the use of various forms of strip caster, such as the well-known Hunter twin-roll strip caster, which typically produces cast strip in a thickness of 5–8 mms.

The cast strip of the present alloy produced in that way may be reduced to the appropriate thickness by cold reduction alone and without any precipitation heat treatment of the cast strip. It may be desirable to apply a conventional recrystallisation annealing treatment before and/or during cold reduction of the cast strip.

We claim:

1. A cold-rolled aluminium alloy sheet product formed of an alloy consisting essentially of
Fe 0.6–1.0%
Si 0.5–0.9%
Cu 0.3–0.5%
Mn up to 0.3%
Ti+B in conventional grain refining amount (Ti+B 0.006–0.06%)
Others up to 0.15% total and 0.05% each
Al balance,
said sheet product being characterized by a combination of a thickness in the range of 15 microns to 3 mms, a grain size of less than 100 microns and a U.T.S. of at least 150 MPa.

2. A cold-rolled aluminium alloy sheet product formed of an alloy consisting essentially of
Fe 0.6–0.8%
Si 0.6–0.8%
Cu 0.3–0.5%
Mn up to 0.2%
Ti and B in conventional grain refining amount (Ti+B 0.006–0.06%)
Others up to 0.15% total and 0.05% each
Al balance,
said sheet product being characterised by a combination of a thickness in the range of 0.15–0.25 mm, an earing value of no more than 2%, a grain size of less than 100 microns and an U.T.S. of at least 150 MPa.

3. An aluminium alloy sheet product as claimed in claim 1 in which the impurity content of magnesium is held below 0.02%.

4. An aluminium alloy sheet product as claimed in claim 1 in which the combined content of iron and silicon is held below 1.6%.

5. An aluminium alloy sheet product as claimed in claim 1, in which the combined content of iron and silicon is held in the range of 1.30–1.50%.

6. An aluminium alloy sheet product as claimed in claim 2 in which the ratio of iron/silicon is above 1.00.

7. An aluminium alloy sheet product as claimed in claim 1 in which the ratio of iron/silicon is in the range of 0.9–1.4.

8. An aluminium alloy sheet product as claimed in claim 1 in which the manganese content is held below 0.2%.

9. An aluminium alloy sheet product having a thickness in the range of 15 microns to 3 mms and work-hardened by being subjected to at least 30% temper rolling to develop an U.T.S. in excess of 150 MPa, said alloy sheet product having a grain size below 100 microns and being produced from an alloy consisting essentially of
Fe 0.6–1.0%
Si 0.5–0.9%
Cu 0.3–0.5%
Mn up to 0.3%
Ti+B in conventional grain refining amount (Ti+B 0.006–0.06%)
Others up to 0.15% total and 0.05% each
Al balance,
said alloy product being produced without a precipitation heat treatment.

10. A work-hardened aluminium alloy sheet product having a thickness in the range of 0.15–0.25 mm, characterised by an earing value of no more than 2%, a grain size below 100 microns and an U.T.S. in excess of 150 MPa developed by applying 30–60% reduction by temper rolling, said alloy product being produced without a precipitation heat treatment from an alloy consisting essentially of
Fe 0.6–0.8%
Si 0.6–0.8%
Cu 0.3–0.5%
Mn up to 0.2%
Ti and B in conventional grain refining amount (Ti+B 0.006–0.06%)
Others up to 0.15% total and 0.05% each
Al balance.

11. An aluminium alloy sheet product as claimed in claim 10 having a Mn content of less than 0.1%.

12. An aluminium alloy sheet product as claimed in claim 11 in which the Mg impurity content is held below 0.02%.

* * * * *

UNITED STATES PATENT AND TRADEMARK OFFICE

CERTIFICATE OF CORRECTION

PATENT NO. : 4,325,755

DATED : April 20, 1982

INVENTOR(S) : John C. Blade et al.

It is certified that error appears in the above-identified patent and that said Letters Patent are hereby corrected as shown below:

Column 4, line 12, "that is" should read --that in-- .

Signed and Sealed this

*Twenty-fifth* Day of *January 1983*

[SEAL]

*Attest:*

GERALD J. MOSSINGHOFF

*Attesting Officer*

*Commissioner of Patents and Trademarks*